US005807151A

United States Patent [19]

Sumino

[11] Patent Number: 5,807,151

[45] Date of Patent: Sep. 15, 1998

[54] PROPELLER FOR MARINE PROPULSION DRIVE

[75] Inventor: Yoshitsugu Sumino, Hamamatsu, Japan

[73] Assignee: Sanshin Kogyo Kabushiki Kaisha, Japan

[21] Appl. No.: 733,494

[22] Filed: Oct. 18, 1996

[30] Foreign Application Priority Data

Oct. 18, 1995 [JP] Japan ..... 7-269756

[51] Int. Cl.[6] ..... B63H 5/10

[52] U.S. Cl. ..... 440/180; 416/129 A

[58] Field of Search ..... 440/49, 80, 81, 440/89; 416/128, 129 R, 129 A

[56] References Cited

U.S. PATENT DOCUMENTS

| | | | |
|---|---|---|---|
| Re. 34,011 | 7/1992 | Brandt | 416/129 |
| 1,019,437 | 3/1912 | Draper . | |
| 1,455,591 | 5/1923 | Lawson | 416/223 |
| 1,639,785 | 8/1927 | Sepúlveda . | |
| 1,813,552 | 7/1931 | Stechauner . | |
| 2,047,847 | 7/1936 | Ambjörnson . | |
| 3,312,286 | 4/1967 | Irgens . | |
| 3,697,193 | 10/1972 | Phillips | 416/242 |
| 4,073,601 | 2/1978 | Kress | 416/242 |
| 4,080,099 | 3/1978 | Snyder | 416/234 |
| 4,331,429 | 5/1982 | Koepsel et al. | 440/49 |
| 4,552,511 | 11/1985 | Sumigawa | 416/242 |
| 4,619,584 | 10/1986 | Brandt | 416/129 A |
| 4,632,636 | 12/1986 | Smith | 416/235 |
| 4,802,822 | 2/1989 | Gilgenbach et al. | 416/235 |
| 5,249,995 | 10/1993 | Meisenburg et al. | 440/81 |
| 5,423,701 | 6/1995 | Rodskier et al. . | |

FOREIGN PATENT DOCUMENTS

| | | | |
|---|---|---|---|
| 268593 | 11/1986 | Japan | 440/81 |
| 382297 | 10/1932 | United Kingdom . | |
| 435993 | 10/1935 | United Kingdom . | |
| 2094894 | 3/1982 | United Kingdom . | |

OTHER PUBLICATIONS

Everything you need to know about Propellers, Revised 3rd Edition, Mercury Marine, division of Brunswick Corp., 1984, (U.S.A. Part No. 90–86144).

*Primary Examiner*—Jesus D. Sotelo

*Attorney, Agent, or Firm*—Knobbe, Martens, Olson & Bear, LLP

[57] ABSTRACT

A blade design for a counter-rotating propeller system improves the performance of the outboard drive on which is it employed when the propellers are run partially exposed. The propeller system includes a pair of counter-rotating propellers that rotate in opposite directions about a common axis. The rear propeller has a smaller diameter—about 92% of the front propeller—and a total blade face surface area of about 85% of the total blade face surface area of the front propeller. The blades of the front and rear propellers desirably have the same camber and generally the same pitch. The rear propeller pitch is between 90% and 110% of the front propeller pitch. These blade parameters improve the efficiency of the rear propeller over prior designs when the propellers run partially exposed in order to maximize the thrust produced by the propulsion system.

28 Claims, 8 Drawing Sheets

PROPELLER FOR MARINE PROPULSION DRIVE

BACKGROUND OF THE INVENTION

1. Field of the Invention

The present invention relates to a marine propulsion device, and more particularly to a blade design for a marine propulsion device.

2. Description of Related Art

Many outboard and stem drives now employ a counter-rotating propeller system. The propeller system includes a pair of propellers arranged in series. The propellers are of opposite hand and rotate in opposite directions to produce a forward driving thrust. The blades of the rear propeller can have a total blade face area that is one-third to two-thirds smaller than the total blade face area of the front propeller blades. See, for example, U.S. Pat. No. Re. 34,011.

Several drawbacks, however, are associated with marine drives employing prior counter-rotating propeller systems, especially when used in connection with a light-weight, high-speed boat, such as a bass fishing boat. The outboard motor on such boat is commonly mounted high to run the propellers partially surfaced. However, with this mounting arrangement, excessive slipping of the rear propeller often occurs. The smaller rear propeller, which operates in the slip-stream of the front propeller, frequently slips due to cavitations generated by the significantly-larger front propeller when surfacing (i.e., ventilating above the water surface). This problem becomes more acute when turning with the rear propeller being largely exposed to air. The rear propeller produces less thrust.

Prior counter-rotating propeller systems have designed the propellers blade to maximize thrust of the propellers when fully submerged. The different operating conditions occurring when the propellers run partially exposed have not been taken into consideration in prior blade designs for counter-rotating propulsion systems.

SUMMARY OF THE INVENTION

A need therefore exists for a propulsion device having a pair of counter-rotating propellers which are designed to improve thrust when running partially exposed.

Thus, one aspect of the present invention involves a propulsion device for a watercraft including a front propeller and a rear propeller which are configured to improve the thrust produced by the propulsion system when the propellers run partially exposed. The propellers are intended to rotate in opposite directions about a common rotational axis. The front and rear propellers each include at least one blade and have a total blade face surface area. The total blade face surface area of the rear propeller is about 85% of the of the total blade face surface area of the front propeller. This general difference in blade face surface area between the front and rear propellers improves the thrust produced by the counter-rotating propulsion system.

Another aspect of the present invention involves a propulsion device for a watercraft. The propulsion device include a front propeller and a rear propeller which are intended to rotate in opposite directions about a common rotational axis. The front propeller has at least one blade. A blade section of the blade, taken along a given pitch line of the blade, has an arcuate shape with a maximum camber of the blade section occurring between the leading and trailing edges of the blade. The rear propeller also has at least one blade. A blade section of the rear propeller blade, which is taken along a corresponding pitch line of the rear propeller blade, likewise has an arcuate shape with a maximum camber occurring between the leading and trailing edges of the rear propeller blade. The blades of the front and rear propeller are configured such that a camber ratio, which is a ratio of the maximum camber of the rear propeller blade to the maximum camber of the front propeller blade, falls within a range from about 0.5 to about 1.5. This ratio has been found to improve the thrust produced by the propulsion device when the propellers are run partially exposed.

In accordance with an additional aspect of the present invention, a marine drive is provided for propelling a watercraft. The marine drive includes an engine which powers a propulsion device. The propulsion device includes a front propeller and a rear propeller that are intended to rotate in opposite directions about a common rotational axis. The propulsion device is mounted to the watercraft in a position where the front and rear propellers run partially exposed. That is, at least a portion of the propeller blades rotate out of a body of water in which the watercraft is operated when the watercraft is planing over the body of water. Means is provided for maximizing the thrust produced by the propellers when running partially exposed.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENT

Figure 1:
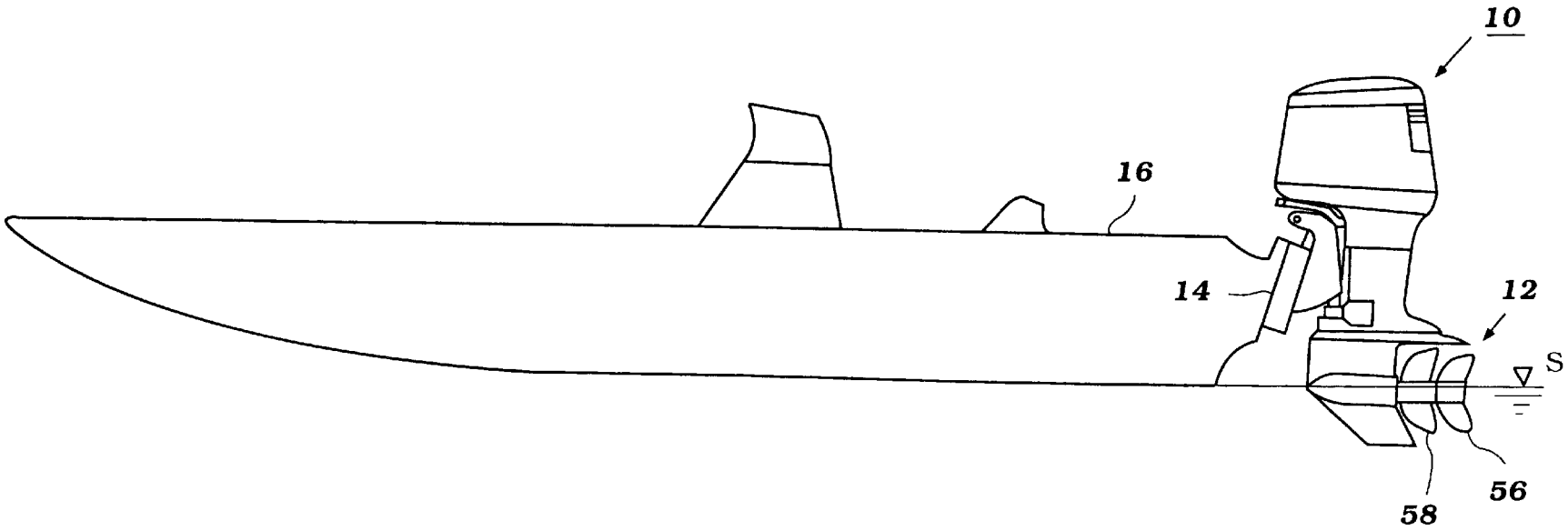
FIG. 1 is a side elevational view of an outboard motor attached to an exemplary watercraft in a high-mount position to run the propellers of the outboard motor partially exposed above the surface of the body of water in which the watercraft is operated.
Figure 2:
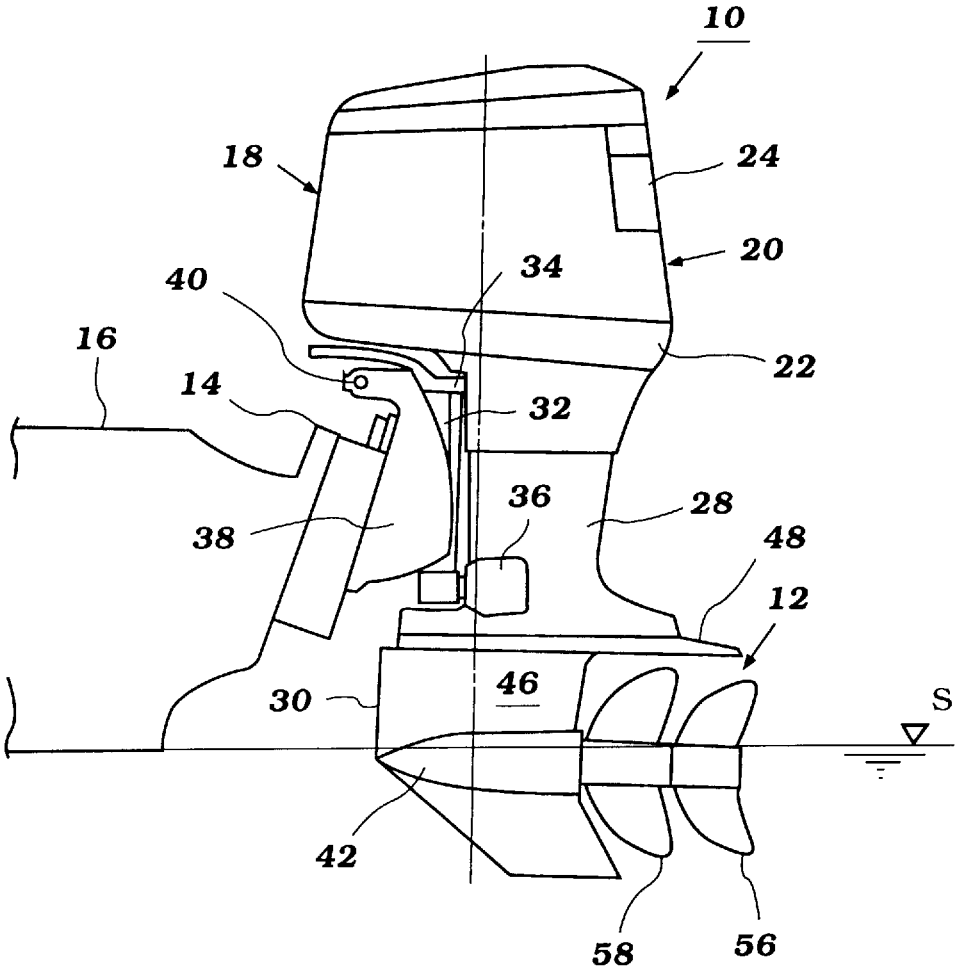
FIG. 2 is a side elevational view of the outboard motor of FIG. 1 which embodies a propulsion device configured in accordance with a preferred embodiment of the present invention.

FIGS. 1 and 2 illustrate a marine outboard drive 10 which incorporates a propulsion device 12 that is configured in accordance with a preferred embodiment of the present invention. In the illustrated embodiment, the outboard drive 10 is depicted as an outboard motor for mounting on a transom 14 of a watercraft 16. It is contemplated, however, that those skilled in the art will readily appreciate that the present invention can be applied to stern drive units of inboard-outboard motors and to other types of watercraft drive units as well.

Figure 3:
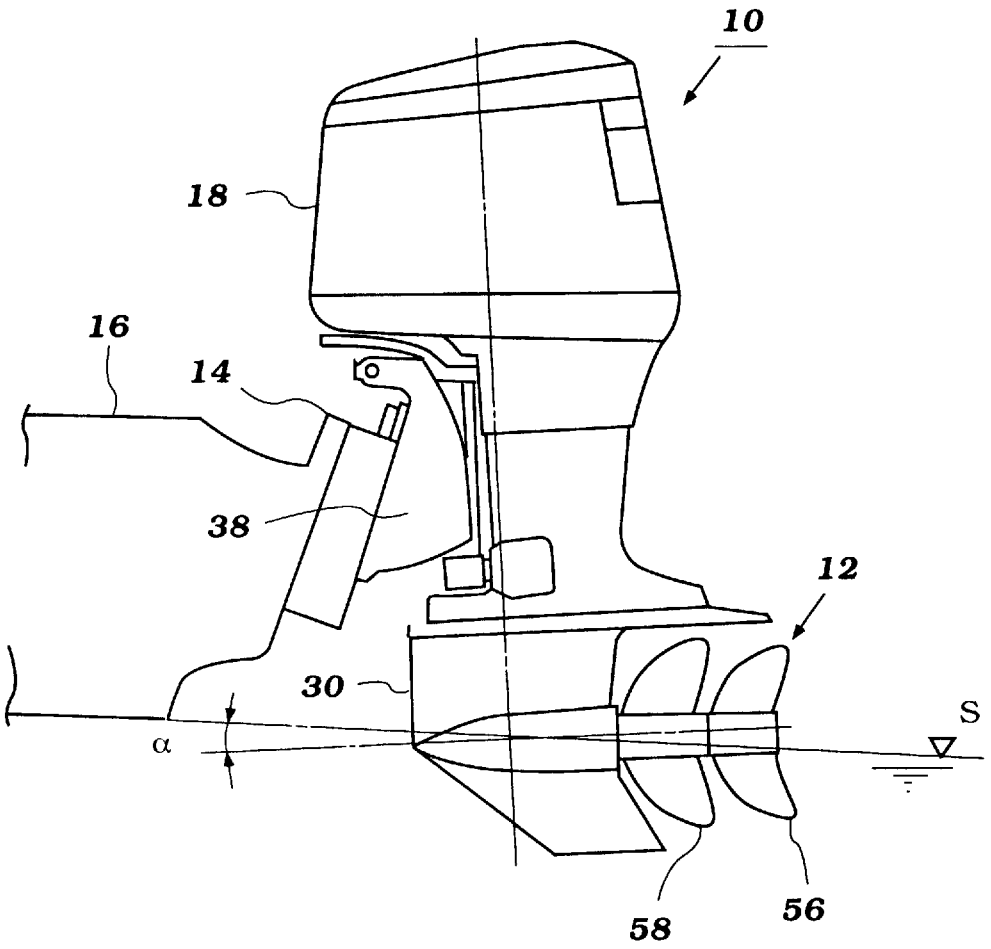
FIG. 3 is a side elevational view of the outboard motor of FIG. 2 in a trimmed-up position.
Figure 4:
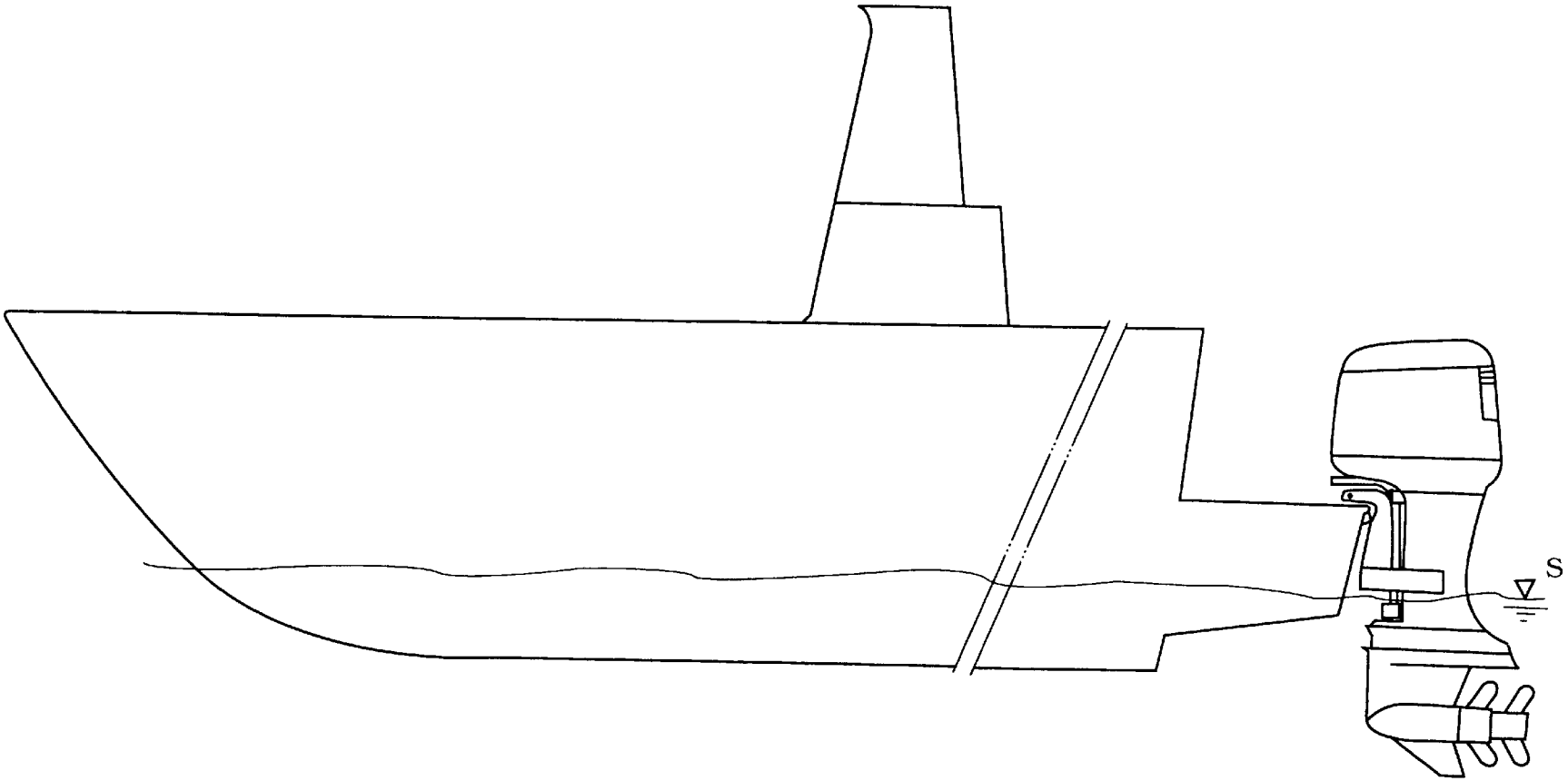
FIG. 4 is a side elevational view of an outboard motor attached to a transom of an exemplary watercraft in a low-mount position to maintain the propellers of the outboard motor completely submerged.

As mentioned above, the present propulsion device 12 is designed to improve thrust efficiency when run with the marine drive 10 secured to the watercraft 16 in a high-mount position on the transom 14. In this high-mount position, as seen in FIGS. 1 through 3, the outboard drive 10 is positioned such that the propulsion device 12 pierce through the water surface S of the body of water in which the watercraft is operated when the watercraft 16 is up on plane. Prior propellers designs for counter-rotating propulsion devices, however, have been designed for propellers that run fully submerged, as shown in FIG. 4. These prior designs thus have not accounted for the different operating conditions that occur when the propellers run partially exposed.

In the illustrated embodiment, as best seen in FIGS. 2 and 3, the high-mount position of the outboard drive 10 on the transom 14 locates the rotational axis of the propulsion device 12 beneath the water surface S when the watercraft 16 is planing. This position of the rotational axis allow for a degree of trim adjustment, as understood by a comparison between trim angles $\alpha$ of the outboard motor 10 shown in FIGS. 2 and 3.

With reference to FIG. 2, the outboard drive 10 has a power head 18 which includes an engine (not shown). A conventional protective cowling 20 surrounds the engine. The cowling 20 desirably includes a lower tray 22 and a top cowling member 24. These components 22, 24 of the protective cowling 20 together define an engine compartment which houses the engine.

The engine is mounted conventionally with its output shaft (i.e., crankshaft) rotating about a generally vertical axis. The crankshaft (not shown) drives a drive shaft 26 (see FIG. 5), as known in the art. The drive shaft 26 depends from the power head 18 of the outboard drive 10.

A drive shaft housing 28 extends downward from the lower tray 20 and terminates in a lower unit 30. As understood from FIG. 2, the drive shaft 26 extends through and is journaled within the drive shaft housing 28.

A steering shaft assembly 32 is affixed to the drive shaft housing 28 by upper and lower brackets 34, 36. The brackets 34, 36 support the shaft 32 for steering movement. Steering movement occurs about a generally vertical steering axis which extends through the steering shaft 32. A steering arm (not shown) which is connected to an upper end of the steering shaft can extend in a forward direction for manual steering of the outboard drive 10, as known in the art.

The steering shaft assembly 36 also is pivotably connected to a clamping bracket 38 by a pin 40. The clamping bracket 38, in turn, is configured to attached to the transom 14 of the watercraft 16. This conventional coupling permits the outboard drive 10 to be pivoted relative to the pin 40 to permit adjustment of the trim position of the outboard drive 10 and for tilt-up of the outboard drive 10.

Although not illustrated, it is understood that a conventional hydraulic tilt and trim cylinder assembly, as well as a conventional hydraulic steering cylinder assembly can be used as well with the present outboard drive 10. The construction of the steering and trim mechanism is considered to be conventional and, for that reason, further description is not believed necessary for appreciation and understanding of the present invention.

Figure 5:
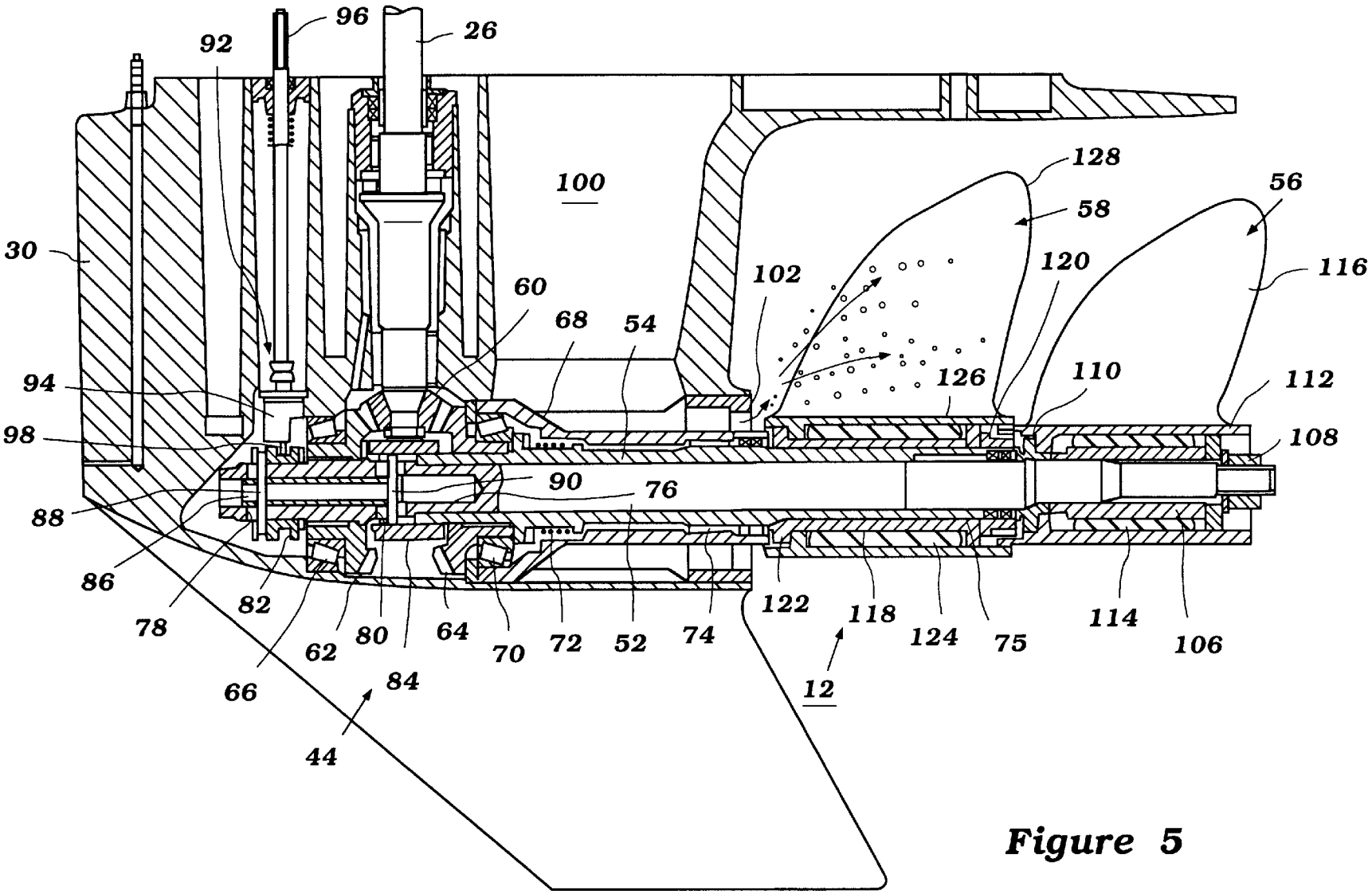
FIG. 5 is a cross-sectional, side elevational view of a lower unit and the propulsion device of the outboard motor of FIG. 2.

The lower unit 30 includes a nacelle 42 with houses a transmission 44 (see FIG. 5). A strut 46 suspends the nacelle 42 beneath an upper cavitation plate 48. The cavitation plate 48 extends over the nacelle 42 and beyond a rear end of the nacelle 42 to cover at least a portion of the propulsion device 12. As seen in FIG. 1, the outboard drive 10 desirably is positioned on the watercraft transom 14 such that the captivation plate 48 resides at a height above the water surface S when the watercraft 16 is up on plane (i.e., planing over the body of water).

As illustrated in FIG. 5, the drive shaft 26 extends from the drive shaft housing 28 into the lower unit 30 where the transmission 44 selectively couples the drive shaft 26 to an inner propulsion shaft 52 and to an outer propulsion shaft 54. The transmission 44 advantageously is a forward/neutral/reverse-type transmission. In this manner, the drive shaft 26 drives the inner and outer propulsion shafts 52, 54 (which rotate in a first direction and in a second counter direction, respectively) in any of these operational states, as described below in detail.

The propulsion shafts 52, 54 drive the propulsion device 12. The propulsion device 12 is a counter-rotating propeller device that includes a rear propeller 56 designed to spin in one direction and to assert a forward thrust, and a front propeller 58 designed to spin in the opposite direction and to assert a forward thrust. The counter-rotational propulsion device 12 will be explained in detail below.

The drive shaft 26 carries a drive gear 60 at its lower end, which is disposed within the lower unit 30 and which forms a portion of the transmission 60. The drive gear 44 preferably is a bevel type gear.

The transmission 44 also includes a pair of counter-rotating driven gears 62, 64 that are in mesh engagement with the drive gear 60. The pair of driven gears 62, 64 preferably are positioned on diametrically opposite sides of the drive gear 60, and are suitably journaled within the lower unit 30, as described below. Each driven gear 62, 64 is positioned at about a 90° shaft angle with the drive gear 60. That is, the propulsion shafts 52, 54 and the drive shaft 26, desirably intersect at about a 90° shaft angle; however, it is contemplated that the drive shaft 26 and the propulsion shafts 52, 54 can intersect at almost any angle.

In the illustrated embodiment, the pair of driven gears 62, 64 are a front bevel gear and an opposing rear bevel gear. The front gear 62 includes a hub which is journaled within the lower unit 30 by a front thrust bearing 66. The front thrust bearing 66 rotatably supports the front gear 62 in mesh engagement with the drive gear 60. The hub has a central bore through which the inner propulsion shaft 52 passes when assembled. The inner propulsion shaft 52 is suitably journaled within the central bore of the front gear hub.

The front gear 62 also includes a series of teeth on an annular front-facing engagement surface, and includes a series of teeth on an annular rear-facing engagement surface. The teeth on each surface positively engage a portion of a clutch of the transmission 44, as described below.

The rear gear 64 also includes a hub which is suitably journaled within a bearing carrier 68 by a rear thrust bearing 70. The rear thrust bearing 70 rotatably supports the rear gear 64 in mesh engagement with the pinion 60.

The hub of the rear gear 64 has a central bore through which the inner propulsion shaft 52 and the outer propulsion shaft 54 pass. The rear gear 64 also includes an annular front engagement surface which carries a series of teeth for positive engagement with a clutch of the transmission 44, as described below.

The inner propulsion shaft 52 and the hollow outer propulsion shaft 54 are disposed within the lower unit 30. The bearing casing 68 rotatably supports the outer propulsion shaft 54. A front needle bearing assembly 72 journals a front end of the outer propulsion shaft 54 within the bearing casing 68. A needle bearing assembly 74 supports the outer propulsion shaft 54 within the bearing casing 68 at an opposite end of the bearing casing 68 from the front bearing assembly 72.

As seen in FIG. 5, the inner propulsion shaft 52, as noted above, extends through front gear hub and the rear gear hub, and is suitably journaled therein. On the rear side of the rear gear 64, the inner shaft 52 extends through the outer shaft 54 and is suitably journaled therein by at least one needle bearing assembly 75 which supports the inner shaft 52 at the rear end of the outer shaft 54.

The front end of the inner propulsion shaft 52 includes a longitudinal bore 76. The bore 76 stems from the front end of the inner shaft 52 to a bottom surface which is positioned on the rear side of the axis of the drive shaft 26. A front aperture 78 extends through the inner shaft 52, transverse to the axis of the longitudinal bore, at a position forward of the front bevel gear 62. The inner shaft 52 also includes a rear aperture 80 that extends transverse to the axis of the longitudinal bore 76 and is generally symmetrically positioned between the front bevel gear 62 and the rear bevel gear 64.

As seen in FIG. 5, the transmission 44 also includes a front dog clutch 82 and a rear dog clutch 84 coupled to a plunger 86. The front dog clutch 82 selectively couples the inner propulsion shaft 52 to the front gear 62. The rear dog clutch 84 selectively couples the outer propulsion shaft 54 to either the front gear 62 or to the rear gear 64. FIG. 5 illustrates the front dog clutch 82 and the rear dog clutch 84 set in a neutral position (i.e., in a position in which the clutches 82, 84 do not engage either the front gear 62 or the rear gear 64).

The plunger 86 has a generally cylindrical rod shape and slides within the longitudinal bore 76 of the inner shaft 52 to actuate the clutches 82, 84. The plunger 86 may be solid; however, it is preferred that the plunger 86 be hollow.

The plunger 86 includes a front hole that is positioned generally transverse to the longitudinal axis of the plunger 86, and a rear hole that is likewise positioned generally transverse to the longitudinal axis of the plunger 86. Each hole desirably is located symmetrically in relation to the corresponding apertures of the inner propulsion shaft 52.

The front dog clutch 82 has a generally cylindrical shape that includes an axial bore. The bore extends through an annular front end and a flat annular rear end of the clutch 82. The bore is sized to receive the inner propulsion shaft 52. Internal splines are formed on the wall of the axial bore. The internal splines mate with external spines formed on the front end of the inner propulsion shaft 52. The resulting spline connection establishes a driving connection between the front clutch 82 to the inner propulsion shaft 52, while permitting the clutch 82 to slide along the front end of shaft 52.

The annular rear end surface of the clutch 82 lies generally transverse to the longitudinal axis of the inner propulsion shaft 52. The rear surface of the front dog clutch 82 also is substantially coextensive in the area with the annular front surface of the front gear 62. Teeth extend from the clutch rear surface in the longitudinal direction and desirably corresponds with the teeth on the front surface of the front driven gear 62, both in size (i.e., axial length), in number, and in configuration.

A pair of annular grooves circumscribe the exterior of the front clutch 82. A front groove is sized to receive a retaining spring, as described below. The rear groove is sized to cooperate with an actuator mechanism, which will be described below.

The front clutch 82 also includes a traverse hole that extends through the clutch at the location of the front annular groove. The hole is sized to receive a pin 88 which, when passed through the front aperture 78 of the inner propulsion shaft 52 and through the front hole of the plunger 86, interconnects the plunger 86 and the front clutch 82 with the front clutch 82 positioned on the inner propulsion shaft 44. The pin 88 may be held in place by a press-fit connection between the pin 88 and the front hole, or by a conventional coil spring (not shown) which is contained within the front annular groove about the exterior of the front clutch 82.

The rear clutch 84 is disposed between the two counter-rotating driven gears 62, 64. The rear clutch 84 has a tubular shape that includes an axial bore which extends between an annular front end and an annular rear end. The bore is sized to receive a portion of the outer propulsion shaft 54, which is positioned about the inner propulsion shaft 52.

The annular end surfaces of the rear clutch 84 are substantially coextensive in size with the annular engagement surfaces of the front and rear gears 62, 64, respectively. Teeth extend from the front end of the rear clutch 84 and desirably correspond to the respective teeth of the front gear 62 in size (e.g., axial length), in number, and in configuration. Teeth likewise extend from the rear end surface of the rear clutch 84 and desirably correspond to the respective teeth of the rear gear 64 in size (e.g., axial length), in number, and in configuration.

A spline connection couples the rear clutch 84 to the outer propulsion shaft 54. The clutch 84 thus drives the outer propulsion shaft 54 through the spline connection, yet the clutch 84 can slide along the front end of the shaft 54 between the front and rear gears 62, 64.

The rear clutch 84 also includes a counterbore. The counterbore is sized to receive a coupling pin 90 which extends through the rear aperture 80 of the inner propulsion shaft 52 and through the rear slot of the plunger 86. The pin 90 has a diameter smaller than the length of the aperture 80.

The ends of the pin 90 desirably are captured by an annular bushing which is interposed between a pair of roller bearings. The assembly of the bushings and bearings is captured between a pair of washers and locked within the counterbore of the rear dog clutch 84 by a retainer ring (not shown). The roller bearings journal the assembly of the bushing and the pin 90 within the counterbore to allow the bushing and the pin 90 to rotate in an opposite direction from the rear clutch 84. The pin 90, being captured within the counterbore of the rear clutch 84, however, couples the plunger 86 to the rear clutch 84 in order for the plunger 86 to actuate the rear clutch 84, as described below.

An actuator mechanism 92 moves the plunger 86 of the clutch assembly from a position establishing a forward drive condition, in which the front and rear clutches 82, 84 engage the front and rear gears 62, 64, respectively, through a position of non-engagement (i.e., the neutral position), and to a position establishing a reverse drive condition, in which the rear clutch 84 engages the front gear 62. The actuator mechanism 92 positively reciprocates the plunger 86 between these positions.

The actuator mechanism 92 includes a cam member 94 that connects the front clutch 82 to a rotatable shift rod 96.

In the illustrated embodiment, the shift rod 96 is journaled for rotation in the lower unit 30 and extends upwardly to a transmission actuator mechanism (not shown) positioned within the outboard motor cowling 20. The actuator mechanism 92 converts rotational movement of the shift rod 96 into linear movement of the front clutch 82 to move the front clutch 82, as well as the plunger 86 and the rear clutch 84, along the axis of the propulsion shaft 52, 54.

The cam member 94 is affixed to a lower end of the shift rod 96. The cam member 94 includes an eccentrically positioned drive pin 98 which extends downwardly from the cam member 94. The cam member 94 also includes a cylindrical upper portion which is positioned to rotate about the axis of the shift rod 96 and is journaled within the lower unit 30. The drive pin 98 extends into the rear annular groove of the front clutch 82 and is sized to slide within the groove.

The drive pin 98 of the cam member 94 moves both axially and transversely with rotation of the cam member 94 because of the eccentric position of the drive pin 98 relative to the rotational axis of the shift rod 96. The pin 98 transfers the linear or axial component of the eccentric motion of the cam member 94 to the front clutch 82. The transverse component of the cam member's motion, however, is not transferred to the front clutch 82. This motion is lost as the pin 98 slides within the rear groove of the front clutch 82. The actuator mechanism 92 configured accordingly positively moves the front clutch 82 along the axis of the inner propulsion shaft 52 with rotational movement of the cam member 94 operated by the shift rod 96. The coupling between the actuator mechanism 92 and the front clutch 82, however, allows the front clutch 82 to rotate with the inner propulsion shaft 52 relative to the drive pin 98.

The pin 88, which connects the front clutch 82 to the plunger 86, causes the plunger 86 to rotate with the front clutch 82 and the inner propulsion shaft 52. The coupling also conveys the axial movement of the clutch 82 driven by the actuator mechanism 92 to the plunger 86. The plunger 86 consequently moves the rear clutch 84.

As noted above, the bearing carrier 68 supports the propulsion shifts 52, 54 on a side of the transmission 44 opposite of the shift actuator mechanism 92. In the illustrated embodiment, the bearing carrier 68 lies within the lower unit 30, and more specifically within an exhaust discharge conduit 100 of the lower unit 30. The exhaust discharge conduit 100 forms a part of an exhaust system.

The exhaust system discharges engine exhaust from an engine manifold of the engine. The engine manifold of the engine communicates with an exhaust conduit formed within an exhaust guide positioned at the upper end of the drive shaft housing 28. The exhaust conduit of the exhaust guide opens into an expansion chamber.

The expansion chamber is formed within the drive shaft housing 28 and communications with the discharge conduit 100 (see FIG. 5) formed within the lower unit 30. The exhaust conduit 100 in the lower unit 30 extends from an upper end of the lower unit 30 to an exhaust outlet 102 formed on a rear wall of the lower unit 30. The exhaust outlet 102 desirably has a circular shape and generally is concentrically positioned about a common drive axis of the shafts 52, 54.

The discharge conduit 100 terminates at a discharge end 102 formed on the rear side of the lower unit 30. In this manner, engine exhaust is discharged into the water in which the watercraft 15 is operating and in the vicinity of the propellers 56, 58 to produce a cavitation effect about the front propeller 58 to thereby improve acceleration from low speeds, as described below.

As noted above, the propeller shafts 52, 54, when coupled to the drive shaft 26 by the transmission 44, drive the propulsion device 12. The propulsion device 12 will now be described principally in reference to FIGS. 5–11.

As seen in FIG. 5, the inner shaft 52 extends beyond the rear end of the outer shaft 54. The rear end of the inner shaft 52 carries an engagement sleeve 106 of the rear propeller 56. The engagement sleeve 106 has a spline connection with the rear end of the inner shaft 52. The sleeve 106 is fixed to the inner shaft rear end between a nut 108 threaded on the rear end of the shaft 52 and an annular thrust washer 110 that engages the inner shaft 52 proximate to the rear end of the outer shaft 54.

The inner shaft 52 also carries a rear propeller boss 112. An elastic bushing 114 is interposed between the engagement sleeve 106 and the propeller boss 112 and is compressed therebetween. The bushing 114 is secured to the engagement sleeve 106 by a heat process known in the art. The frictional engagement between the boss 112, the elastic bushing 114, and the engagement sleeve 106 is sufficient to transmit rotational forces from the sleeve 106, driven by the inner propulsion shaft 52, to propeller blades 116 attached to the propeller boss 112.

The outer shaft 54 carries the front propeller 58 in a similar fashion. As best seen in FIG. 5, the rear end portion of the outer shaft 54 carries a second engagement sleeve 118 in driving engagement thereabout by a spline connection. The second engagement sleeve 118 is secured onto the outer shaft 54 between a retaining ring 120 and a second annular thrust washer 122.

A second annular elastic bushing 124 surrounds the second engagement sleeve 118. The bushing 124 is secured to the sleeve 118 by a heat process known in the art.

A front propeller boss 126 surrounds the elastic bushing 118, which is held under pressure between the boss 126 and the sleeve 118 in frictional engagement. The frictional engagement between the propeller boss 126 and the bushing 118 is sufficient to transmit a rotational force from the sleeve 118 to blades 128 of the front propeller 58 attached to the front propeller boss 126.

As seen in FIG. 5, a rear end of the second boss 126 and a front end of the first boss 112 generally lie adjacent to each other so as to generally enclose the rear end of the outer propulsion shaft 54, the retainer ring 120, and the first thrust flange 110.

The blades 116, 128 of the rear and front propellers 56, 58 desirably are configured to improve the thrust produced by the propulsion device 12. The configurations of the front and rear propeller blades 116, 128 will be described principally in reference to FIGS. 6–11.

Figure 6:
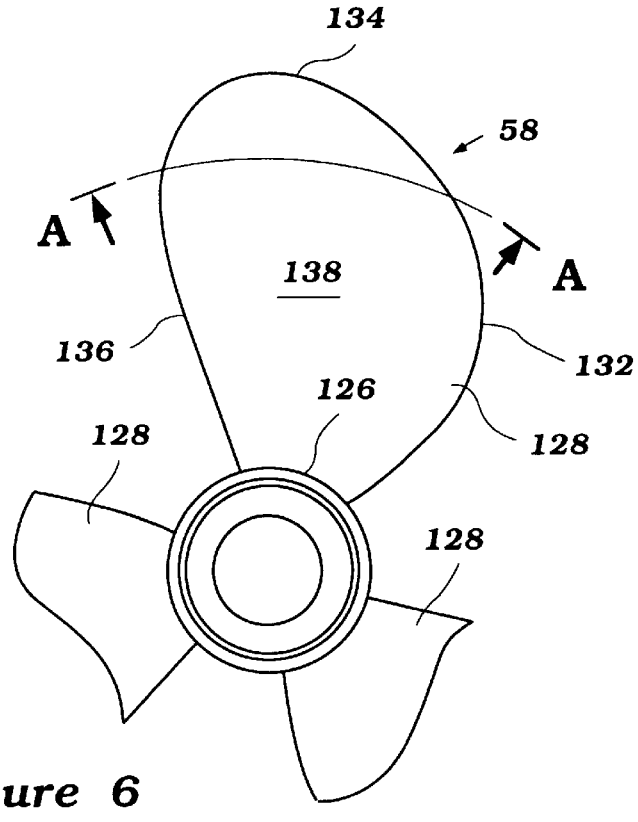
FIG. 6 is a partial front plan view of the front propeller of FIG. 5.

With reference to FIG. 6, the front propeller desirably includes a plurality of propeller blades 128, although a single blade can be used. In the illustrated embodiment, the front propeller 58 includes three blades 128 to optimize vibration, size, efficiency and cost, as known in the art. Each blade 128 desirably has the same shape and size.

The blade 128 has a leading edge 132 that extends from the sleeve of the boss 126 to a blade tip 134. The blade tip 134 is the maximum reach of the blade 128 from the center of the propeller boss 126. The leading edge 132 lies on the side edge of the blade 128 which first cuts through the water and which lies closest to the lower unit 30.

The blade 128 also includes a trailing edge 136. The trailing edge 136 is that part of the blade that lies furthest from the lower unit 30 and from which the water leaves the blade 128. The trailing edge 136 also extends from the sleeve of the boss 126 to the blade tip 134.

Figure 7:
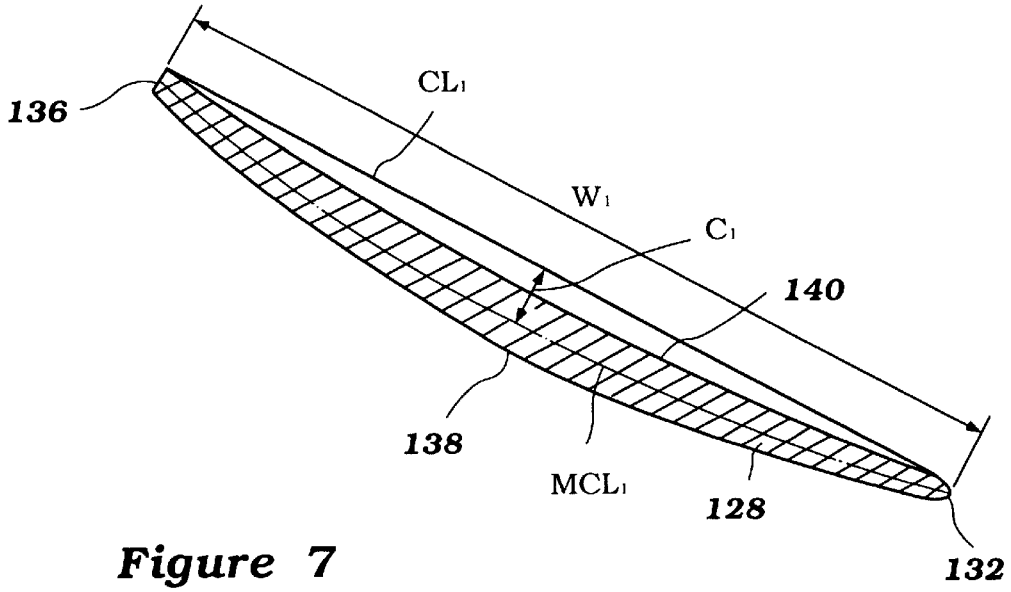
FIG. 7 is a sectional view of a propeller blade of the front propeller of FIG. 6 taken along pitch line A—A.

With reference to FIGS. 6 and 7, a blade back 138 extends between the leading and trailing edges 132, 136 on a side of the blade 128 closest to the lower unit 30. The surface of the blade back 138 generally has a convex shape, as seen in FIG. 7.

A blade face 140 extends between the leading and trailing edges 132, 136 on the opposite side of the blade 128, i.e., on the side furthest from the lower unit 30. The blade face 140 functions as the positive pressure side of the blade 128, while the blade back 138 functions as the negative pressure side, as known in the art.

The shapes of the blade face 140 and the blade back 138 are best understood by examining a blade section or cutaway taken along a particular pitch line (indicated as line A—A in FIG. 6). As is conventional, the shape of the blade 128 will be discussed at a radius r which is 7/10 of overall radius R (i.e., 70% of the distance from the propellers center of rotation to the blade tip). The radius r at this pitch line is commonly referred to as the 7/10 radius. The section at the 7/10 radius most typically represents the entire blade 128, as known in the art.

FIG. 7 illustrates a section of the blade 128 taken along the pitch line at the 7/10 radius (see FIG. 6). The blade face 140 has a generally concave shape, while the blade back 138 has a corresponding convex shape. The blade thickness increases from the edges 132, 136 of the blade 128 toward the center of the blade 128. The maximum thickness of the blade occurs at a mid-point between the leading and trailing edges 132, 136.

The blade 128 has a width $W_1$ measured as the straight distance between the leading and trailing edges 132, 136. A chord line $CL_1$ connecting the leading and trailing edges 132, 136, as seen in FIG. 7. A major design feature of the blade 128 is the mean camber line $MCL_1$, which is the locus of points halfway between the blade face 140 and the blade back 138 as measured perpendicular to the mean camber line $MCL_1$ itself.

As seen in FIG. 7, the mean camber line $MCL_1$ of the present blade section has an arcuate shape. In the illustrated embodiment, the mean camber line $MCL_1$ is shaped in a circular arc having a constant radius of curvature.

The camber $C_1$ of the blade 128 is defined between the mean camber line $MCL_1$ and the chord line $CL_1$. The blade camber is the maximum distance between the mean camber line $MCL_1$ and the chord line $CL_1$ measured perpendicular to the chord line $CL_1$. The blade camber $C_1$ desirably is no smaller than about 0.5% of the blade width $W_1$. That is, the camber amount of the blade can be expressed as:

$$\text{Camber Amount } (\%) = C_1/W_1 \times 100$$

with the camber amount being generally equal to or greater than 0.5%. The blade camber $C_1$, however, desirably is not larger than about 3.5 percent of the blade width $W_1$. The blade camber preferably is between 1.0% and 2.5% of the blade width $W_1$. This blade configuration improves anti-cavitation, as will be described below.

Figure 8:
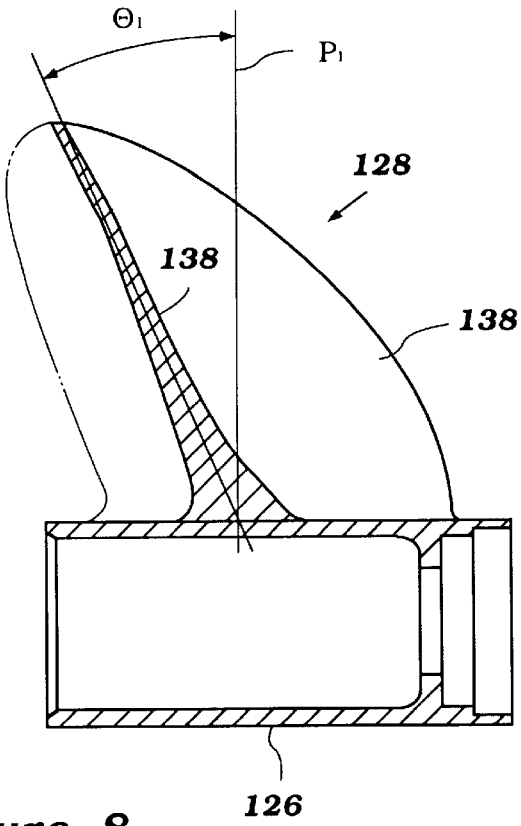
FIG. 8 is a cross-sectional view of a front propeller of the propulsion device of FIG. 5.

FIG. 8 illustrates the blade rake $\Theta_1$ of the blades 128 of the front propeller 58. The blade rake $\Theta_1$ is the angle between the blade face 140 and a plane $P_1$ which lies transverse to the rotational axis A of the propeller 58. In the illustrated embodiment, the rake angle $\Theta_1$ desirably lies within the range from about 0° to about 30°, and more preferably between 15° and 25°. An increased rake angle $\Theta_1$ helps lift the watercraft bow to minimize the contact surface between the watercraft hull 50 and the water and to thereby reduces resistance on the hull 50. The top speed of the watercraft 16 consequently increases.

Figure 11:
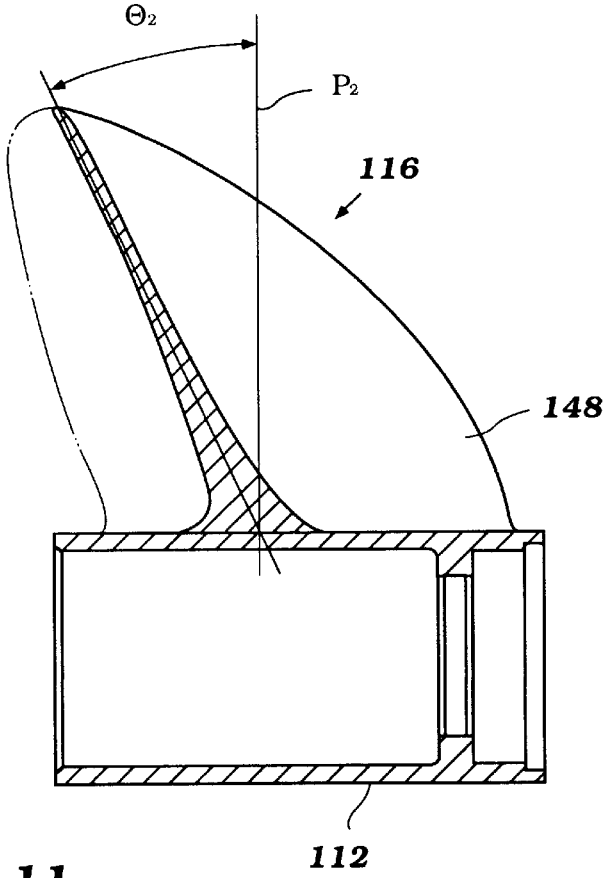
FIG. 11 is a cross-sectional view of a rear propeller of the propulsion device of FIG. 5.
Figure 9:
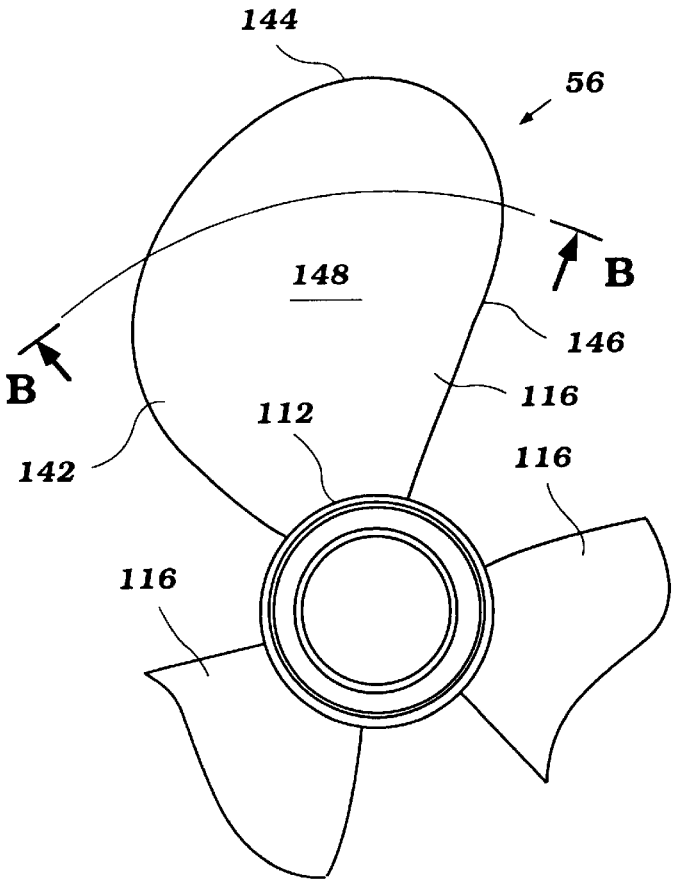
FIG. 9 is a partial front plan view of the rear propeller of FIG. 5.
Figure 10:
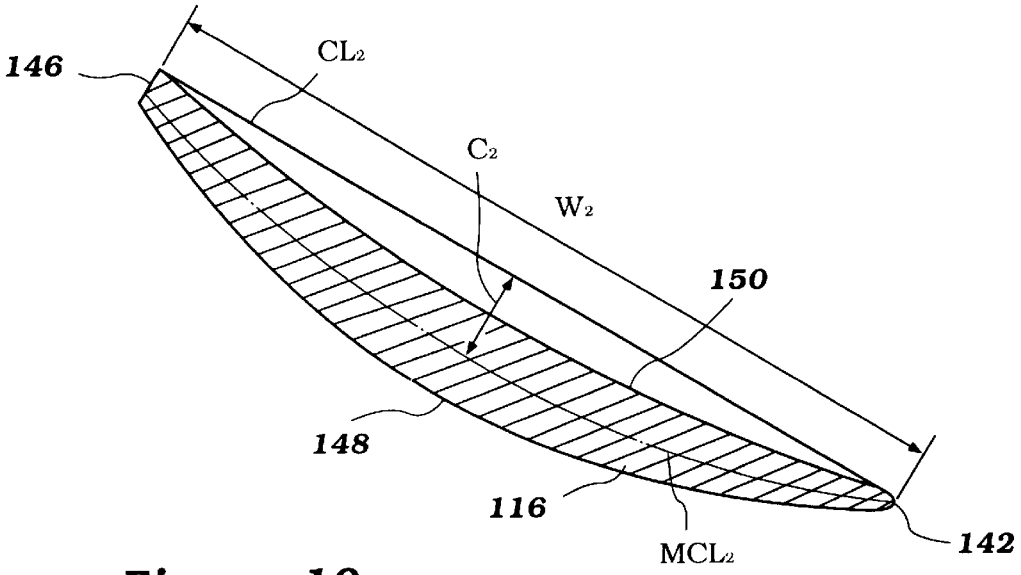
FIG. 10 is a sectional view of a propeller blade of the rear propeller of FIG. 9 taken along pitch line B—B.

With reference to FIGS. 9 through 11, the rear propeller 56 desirably includes the same number of propeller blades 116 as the front propeller 58. In the illustrated embodiment, the rear propeller 56 includes three blades 116; however, the present invention can be practice with other number of blades.

The shape of the blades 116 desirably is generally similar to that of the front propeller blades 128. The blade 116 has a leading edge 142 that extends from the sleeve of the boss 112 to a blade tip 144. The blade 116 also includes a trailing edge 146 which extends from the sleeve of the boss 112 to the blade tip 144.

With reference to FIGS. 9 and 10, a blade back 148 extends between the leading and trailing edges 142, 146 on a side of the blade 116 closest to the lower unit 30. The surface of the blade back 148 generally has a convex shape, as seen in FIG. 10.

A blade face 150 extends between the leading and trailing edges 142, 146 on the opposite side of the blade 116, i.e., on the side furthest from the lower unit 30. The shapes of the blade face 150 and the blade back 148 are best understood by examining a blade section or cutaway taken along a particular pitch line (indicated as line B—B in FIG. 9). As is conventional, the shape of the blade 128 will be discussed at the 7/10 radius.

FIG. 10 illustrates a section of the blade 116 taken along the pitch line at the 7/10 radius (see FIG. 6). The blade face 150 has a generally concave shape, while the blade back 148 has a corresponding convex shape. The blade thickness increases from the edges 142, 146 of the blade 116 toward the center of the blade 116. The maximum thickness of the blade occurs at a mid-point between the leading and trailing edges 142, 146. As understood by a comparison between FIGS. 7 and 10, the rear propeller blades 116 have a thickness greater than the thickness of the front propeller blades 128.

The blade 116 has a width $W_2$ measured as the straight distance between the leading and trailing edges 132, 136. A chord line $CL_2$ connecting the leading and trailing edges 142, 146, as seen in FIG. 10. The arcuate shape of the blade 116 produces a curved mean camber line $MCL_2$. In the illustrated embodiment, the mean camber line $MCL_2$ is shaped in a circular arc having a constant radius of curvature.

The camber $C_2$ of the blade 116 is defined between the mean camber line $MCL_2$ and the chord line $CL_2$. Like the blade camber of the front propeller blades, the blade camber $C_2$ of the rear propeller blades desirably is no smaller than about 0.5% of the blade width $W_2$ and not larger than about 3.5% of the blade width $W_2$. The blade camber $C_2$ preferably is between 1.0% and 2.5% of the blade width $W_2$.

FIG. 11 illustrates the blade rake $\Theta_2$ of the blades 128 of the front propeller 58. The blade rake $\Theta_2$ is the angle between the blade face 140 and a plane $P_2$ which lies transverse to the rotational axis A of the propeller 58. In the illustrated embodiment, the rake angle $\Theta_2$ desirably lies within the range from about 0° to about 30°, and more preferably between 15° and 25°.

The rear propeller blade 116 desirably is slightly smaller than the front propeller blade 128. The size difference is best articulated by comparing the total surface area of the blade front faces of the front and rear propellers 58, 56 (i.e., comparing the total blade face surface area of the rear propeller 116 with the total blade face surface area of the front propeller 128). The total blade face surface area of the rear propeller 116 desirably is no smaller than about seventy percent (70%) of the total blade face surface area of the front propeller 128. The larger blade face surface of the rear propeller 116, as compared with conventional rear propellers which are much smaller (e.g., one to two-thirds the size of the front propeller), substantially reduces blade slipping and improves the handling stability of the watercraft 16 when tuning, while still obtaining many of the advantages realized by a smaller rear propeller. The total blade surface area of the rear propeller 116 preferably equals about 85%, plus or minus a few percent. Expressed as a ratio $r_s$ of the total blade face surface area of the rear propeller 56 to the total blade face surface area of the front propeller 58, $$1>r_s\geqq 0.7;$$

and preferably $r_s$ generally equals 0.85.

The diameter size of the front and rear propellers 58, 56 desirably are selected in accordance with the torque delivered by the corresponding propeller shaft, the desired efficiency of the propulsion device, and the desired top speed of the watercraft 16, as known in the art. The diameter of the propeller is the distance across the circle made by the blade tips as the propeller rotates. In other word, the diameter is twice the overall radius R of the blade from the rotational axis of the propeller to blade tip.

The diameter of the rear propeller preferably is equal to or smaller than the diameter of the front propeller. In other words, a diameter ratio $r_D$ of the diameter of the rear propeller 56 to the diameter of the front propeller 58 falls within the range from about 0.7 to about 1.0. The diameter ratio $r_D$ between the front and rear propellers 56, 58 desirably equals about 0.92.

The curved sectional-shape of each blade 116, 128 along a pitch line of the front and rear propellers 58, 56 gives each blade varying pitch. Pitch is the distance that a propeller would theoretically move through a soft solid in one revolution.

A pitch ratio $r_P$ between the average pitch of the rear propeller 56 and the average pitch of the front propeller 58 desirably falls within a range from about 0.7 to about 1.3, and preferably within a range from about 0.9 to about 1.1.

The blades 116, 128 of the rear and front propellers 56, 58 also are selected to have a desired camber ratio $r_c$. The camber ratio $r_c$ is a ratio between the camber $C_2$ of the rear propeller blades 116 and the camber $C_1$ of the front propeller blades 128. The camber ratio $r_c$ preferably falls within the range from about 0.5 to about 1.5, and more preferably about equals 1.0.

Each of the above blade parameters of the front and rear propellers 56, 58 contribute to an improved thrust efficiency of the propulsion device 12. The propellers 56, 58 of the propulsion device 12 desirably have the following blade parameters in order to maximize thrust efficiency when the watercraft 16 is up on plane:

| Blade Parameters | Preferred Values |
|---|---|
| Blade Area Ratio $r_S$ | 0.85 |
| Diameter Ratio $r_D$ | 0.92 |
| Blade Pitch Ratio $r_P$ | 0.9–1.1 |
| Camber Ratio $r_C$ | 1.0 |

-continued

| Blade Parameters | Preferred Values |
|---|---|
| Camber % | 1.0%–2.5% |
| Rake Angle | 15%–25% |

However, propellers with blade parameters within the acceptable ranges provided above will produce some degree of improved thrust efficiency.

The present propulsion device 12 in its forward drive mode thus provides good propulsion efficiency and minimizes drag under normal running conditions. At low propeller speeds, exhaust gas is discharged in front of the front propeller 58 and aerates the water around the propeller blades 128. As schematically illustrated in FIG. 5, the action of the blades 128 of the propeller 58 drive the exhaust gases outwardly away from the hub 126 of the front propeller 58. The exhaust gases flow over the back of the propeller blades 128 to become entrained in the water stream through the propeller 58.

Aeration or cavitation produced by the entrained exhaust gases within the water decrease the viscosity of the water around the blades 128 of the front propeller 58 to reduce resistance on the blades 128. This permits the propeller 58 to accelerate more quickly. Less propeller resistance, in turn, reduces the load applied by the front propeller 58 on the engine, and more power is available to drive the rear propeller 56. The outboard motor 10, consequently, accelerates quicker.

Water speed over the front propeller 58 increases with rising engine and propeller speeds. Under these conditions, the exhaust gases tend to flow over the hubs 112, 126 of the front and rear propellers 58, 56 and have less effect on cavitation. The speed of the exhaust gases, as well as the speed of the water flow through the propellers 56, 58, carries the gases through the front and rear propellers 56, 58 in the vicinity of the bases of the propeller blades 128, 116. As a result, discharge of exhaust gases forward of the propellers 58, 56 causes no significant loss of propulsion efficiency when traveling at high speeds. The exhaust gases, thus, generally create a cavitation effect primarily during acceleration.

Once the watercraft 16 is up on plane, the propellers 56, 58 run partially exposed. The above described blade and propeller designs of the propulsion device 12 improve the efficiency of the rear propeller 56 in order to maximize the thrust of the marine drive 10.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A propulsion device for a watercraft comprising a front propeller and a rear propeller intended to rotate in opposite directions about a common rotational axis, said front and rear propellers each including at least one blade and having a total blade face surface area, the total blade face surface area of the rear propeller being about 85% of the total blade face surface area of the front propeller.

2. A propulsion device as in claim 1, wherein the front and rear propellers each have a blade diameter, and a diameter ratio between the blade diameter of the front propeller and the blade diameter of the rear propeller falls within a range from about 0.7 to about 1.0.

3. A propulsion device as in claim 2, wherein the blade ratio between the blade diameters of the front and rear propellers equals about 0.92.

4. A propulsion device as in claim 1, wherein each blade of the front and rear propellers that has an average pitch, and a propeller pitch ratio of the average pitch of the rear propeller to the average pitch of the front propellers falls within a range of from about 0.7 to about 1.3.

5. A propulsion device as in claim 4, wherein the propeller pitch ratio falls within a range from about 0.9 to about 1.1.

6. A propulsion device as in claim 1, wherein each blade of the front and rear propellers is shaped to have an arcuate-shaped blade section taken along a pitch line of the blade, the blade section of each blade has a camber, and the blades of the front and rear propellers are configured to have a camber ratio that falls within the range from about 0.5 to about 1.5, where the camber ratio is a ratio of the camber of the rear propeller blade to the maximum chamber of the front propeller blade, taken along similar pitch lines.

7. A propulsion device as in claim 6, wherein said camber ratio equals about 1.0.

8. A propulsion device as in claim 6, wherein each blade section lies along a pitch line taken at a 7/10 radius of the corresponding blade.

9. A propulsion device as in claim 6, wherein the camber of each blade of the front and rear propellers is approximately 0.5 to 3.5 percent of the width of said blade.

10. A propulsion device as in claim 9, wherein the camber of each blade of the front and rear propellers is approximately 1.0 to 2.5 percent of the width of said blade.

11. A propulsion device as in claim 1, wherein a rake angle of each blade of the front and rear propellers is between about 0° and about 30°.

12. A propulsion device as in claim 11, wherein a rake angle of each blade of the front and rear propellers is between about 15° and about 25°.

13. A propulsion device for a watercraft comprising a front propeller and a rear propeller intended to rotate in opposite directions about a common rotational axis, said front propeller having at least one blade, a blade section of the blade taken along a pitch line of the blade having an arcuate shape with a camber of the blade section occurring between leading and trailing edges of the blade, and said rear propeller having at least one blade, a blade section of the blade of the rear propeller, which is taken along a corresponding pitch line of the blade, having an arcuate shape with a camber occurring between leading and trailing edges of the blade, the blades of the front and rear propeller being configured such that a camber ratio, which is a ratio of the camber of the rear propeller blade to the camber of the front propeller blade, falls within a range from about 0.5 to about 1.5.

14. A propulsion device as in claim 13, wherein the camber ratio generally equals 1.0.

15. A propulsion device as in claim 13, wherein each blade section lies along a pitch line taken at a 7/10 radius of the corresponding blade.

16. A propulsion device as in claim 13, wherein each blade of the front and rear propellers has a leading edge and a trailing edge with a blade face and a blade back extending between the leading and trailing edges on opposite sides of the propeller blade, and a mean camber line defined through the blade section which has an arcuate shape.

17. A propulsion device as in claim 16, wherein the mean camber line has a constant radius of curvature between the leading and trailing edges.

18. A propulsion device as in claim 17, wherein the camber of each blade of the front and rear propellers is approximately 0.5 to 3.5 percent of the width of the blade.

19. A propulsion device as in claim 18, wherein the camber of each blade of the front and rear propellers is approximately 1.0 to 2.5 percent of the width of the blade.

20. A propulsion device as in claim 13, wherein a rake angle of each blade of the front and rear propellers is between about 0° and about 30°.

21. A propulsion device as in claim 20, wherein a rake angle of each blade of the front and rear propellers is between about 15° and about 25°.

22. A propulsion device as in claim 13, wherein the front and rear propellers each have a blade diameter, and a diameter ratio between the blade diameter of the front propeller and the blade diameter of the rear propeller falls within a range from about 0.7 to about 1.0.

23. A propulsion device as in claim 22, wherein the blade ratio between the blade diameters of the front and rear propellers equals about 0.92.

24. A propulsion device as in claim 13, wherein each blade of the front and rear propellers that has an average pitch, and a propeller pitch ratio of the average pitch of the rear propeller to the average pitch of the front propellers falls within a range of from about 0.7 to about 1.3.

25. A propulsion device as in claim 24, wherein the propeller pitch ratio falls within a range from about 0.9 to about 1.1.

26. A marine drive for propelling a watercraft comprising an engine powering a propulsion device, the propulsion device including a front propeller and a rear propeller intended to rotate in opposite directions about a common rotational axis, the propulsion device being mounted to the watercraft in a position where the front and rear propellers run partially exposed, rotating out of a body of water in which the watercraft is operated when the watercraft is planing over the body of water, the propellers including blade means for maximizing the thrust produced by the propellers when running partially exposed.

27. A marine drive as in claim 26 additionally comprising an exhaust system which communicates with the engine to expel engine exhaust from the marine drive, the exhaust system including a discharge end positioned on the marine drive to discharge exhaust gases in the vicinity of at least one of the propellers of the propulsion system.

28. A marine drive as in claim 27, wherein the discharge end of the exhaust system is positioned to discharge the exhaust gases at a location forward of the front propeller.

* * * * *